US007980885B2

(12) United States Patent
Gattwinkel et al.

(10) Patent No.: US 7,980,885 B2
(45) Date of Patent: Jul. 19, 2011

(54) PLUG ASSEMBLY WITH STRAIN RELIEF

(75) Inventors: Stefan Gattwinkel, Kirchhundem (DE); Wolfgang Beckmann, Kirchhundem (DE)

(73) Assignee: AMAD Mennekes Holding GmbH & Co. KG, Kirchhundem (DE)

( * ) Notice: Subject to any disclaimer, the term of this patent is extended or adjusted under 35 U.S.C. 154(b) by 45 days.

(21) Appl. No.: 12/393,570

(22) Filed: Feb. 26, 2009

(65) Prior Publication Data

US 2009/0221176 A1 Sep. 3, 2009

(30) Foreign Application Priority Data

Mar. 3, 2008 (DE) ..... 10 2008 000 479

(51) Int. Cl.
*H01R 13/58* (2006.01)

(52) U.S. Cl. ..... 439/461; 174/653

(58) Field of Classification Search ..... 439/461, 439/462; 174/653–655
See application file for complete search history.

(56) References Cited

U.S. PATENT DOCUMENTS

| | | | | | |
|---|---|---|---|---|---|
| 4,739,126 | A * | 4/1988 | Gutter et al. | ..... | 174/78 |
| 4,835,342 | A * | 5/1989 | Guginsky | ..... | 174/653 |
| 5,059,747 | A * | 10/1991 | Bawa et al. | ..... | 174/655 |
| 5,087,795 | A * | 2/1992 | Guginsky | ..... | 174/653 |
| 5,405,172 | A * | 4/1995 | Mullen, Jr. | ..... | 285/92 |
| 5,543,582 | A * | 8/1996 | Stark et al. | ..... | 174/653 |
| 5,648,639 | A * | 7/1997 | Hand | ..... | 174/51 |
| 6,149,455 | A * | 11/2000 | Levi | ..... | 439/462 |
| 6,582,248 | B2 * | 6/2003 | Bachman | ..... | 439/462 |
| 7,086,897 | B2 | 8/2006 | Montena | | |
| 7,641,396 | B2 * | 1/2010 | Feldner | ..... | 385/56 |
| 2006/0105628 | A1 | 5/2006 | Montena | | |

FOREIGN PATENT DOCUMENTS

| | | |
|---|---|---|
| CN | 1801534 A | 7/2006 |
| DE | 100 11 341 C2 | 9/2001 |
| EP | 0 921 604 A1 | 6/1999 |
| WO | WO 99/40651 | 8/1999 |

* cited by examiner

*Primary Examiner* — Thanh-Tam T Le
(74) *Attorney, Agent, or Firm* — Henry M. Feiereisen; Ursula B. Day

(57) ABSTRACT

A plug assembly with strain relief includes a housing and a clamping basket which has radially movable clamping fingers. The clamping basket defines an axis and is constructed to allow insertion of a cable into the housing in a direction of the axis. A rotary sleeve is supported on the housing for rotation but substantially fixed in an axial position with respect to the housing. The rotary sleeve is hereby configured to move an element (e.g. the clamping basket itself, or a pinch ring) in the axial direction, when rotated, to thereby modify a radial position of the clamping fingers.

15 Claims, 2 Drawing Sheets

PLUG ASSEMBLY WITH STRAIN RELIEF

CROSS-REFERENCES TO RELATED APPLICATIONS

This application claims the priority of German Patent Application, Serial No. 10 2008 000479.0, filed Mar. 3, 2008, pursuant to 35 U.S.C. 119(a)-(d), the content of which is incorporated herein by reference in its entirety as if fully set forth herein.

BACKGROUND OF THE INVENTION

The present invention relates, in general, to a plug assembly with strain relief.

The following discussion of related art is provided to assist the reader in understanding the advantages of the invention, and is not to be construed as an admission that this related art is prior art to this invention.

German Offenlegungsschrift DE 100 11 341 C2 discloses a plug assembly having a housing and a clamping basket with a ring-shaped carrier wall and clamping fingers extending axially from the carrier wall. The clamping fingers can be forced radially inwards to press against a cable guided through the clamping basket. The clamping fingers are pressed together by threadably engaging a rotary sleeve onto the housing to move the clamping basket in axial direction and thereby press the clamping fingers against conical shoulders of the housing. A substantially cylindrical, elastic sealing collar is loosely arranged or securely molded on inside the clamping basket to seal the strain relief.

It would be desirable and advantageous to provide an improved plug assembly to obviate prior art shortcomings.

SUMMARY OF THE INVENTION

According to one aspect of the present invention, a plug assembly with strain relief includes a housing, a clamping basket having radially movable clamping fingers, with the clamping basket defining an axis and constructed to allow insertion of a cable into the housing in a direction of the axis, and a rotary sleeve supported on the housing for rotation but substantially fixed in an axial position with respect to the housing, with the rotary sleeve being configured to move an element in the axial direction, when rotated, to thereby modify a radial position of the clamping fingers A plug assembly according to the present invention, which may involve in particular a plug or a coupler/socket as described in industrial standards DIN EN 60309 includes a strain relief. The term "strain relief" relates hereby to a mechanism by which an electric cable can be mechanically secured, preferably in a sealed manner, with the housing of the plug assembly so that tensile stress on the cable is transmitted onto the housing rather than onto internal electric connections. The plug assembly according to the present invention includes the following components:

a) A housing which accommodates the components of the plug assembly, such as contact pins, female contacts, electric terminals, etc., and is normally made of plastic or light metal.

b) A clamping basket with radially moving clamping fingers, with a cable being guidable along the axial direction of the clamping basket into the housing. As described above, the clamping fingers are able to bear against the sheathing of such a cable by moving inwards so as to mechanically couple the cable with the clamping basket. The clamping fingers are typically attached to a ring-shaped carrier in an elastically resilient manner so as to assume a predefined idle position in the absence of external forces.

c) A rotary sleeve which is supported on the housing for rotation but assumes a substantially fixed axial position. The term "axial position" relates hereby to a position which corresponds to the course of a cable inserted in the plug assembly. The rotary sleeve has hereby an internal configuration (e.g. internal thread) which, when rotated, moves an element axially, thereby acting on the radial position of the clamping fingers on the clamping basket. In other words, the clamping fingers of the clamping basket are pressed against the sheathing of the cable (or detached therefrom), as the rotary sleeve is rotated.

A plug assembly according to the present invention permits a fixation of the clamping basket of the strain relief upon the cable through rotation of a rotary sleeve, whereby the rotary sleeve substantially maintains its axial position in relation to the housing. Axial movements take place only inside the mechanism, where they are protected from external influences. There is no gap of variable width between rotary sleeve and housing which could be contaminated or cause a jamming of objects or fingers of a user. In addition, the optical look of the plug assembly is enhanced as it has the same look regardless of the clamping state of the clamping basket or cable diameter.

According to another feature of the present invention, the axially movable element may be the clamping basket itself. As a result, there is no need for an additional component besides the housing, rotary sleeve, and clamping basket, to implement the desired clamping effect.

According to another feature of the present invention, the clamping basket may be snugly sealed on the housing and supported on the housing so as to be constraint against executing a rotation. By sealing the clamping basket against the housing, ingress of moisture and/or dirt into the interior of the plug assembly between the clamping basket and the housing is prevented, whereas the anti-rotation mechanism prevents the clamping basket to follow the rotation of the rotary sleeve. The anti-rotation mechanism may be realized, for example, by axial fins on the housing and/or clamping basket.

According to another feature of the present invention, the clamping fingers have an outer surface which may be configured to interact with the housing and/or the rotary sleeve, when the clamping basket is moved in the axial direction. The clamping fingers may, for example, have contact surfaces which extend slantingly in relation to the (cable) axis and rest on a shoulder of the housing so as to be moved radially, as the clamping basket is displaced in axial direction.

According to another feature of the present invention, the axially movable element may be implemented by a separate pinch ring. The pinch ring may act on the clamping basket in a variety of ways during its axial movement. In a simple case, the pinch ring applies directly pressure in radial direction upon the slanted outer surfaces of the clamping fingers. The use of a separate pinch ring is beneficial because the clamping basket can be disposed at a fixed axial position so that there is no relative movement between the clamping basket and the cable being secured.

According to another feature of the present invention, the clamping basket may be formed in one piece with the housing. In this way, the strain relief requires one less loose component and the transition from clamping basket to housing is tight. As an alternative, the clamping basket may represent a separate component which can be attached to the housing. For example, the housing may have a thread or a bayonet lock for attachment of a complementary structure of the clamping basket. The provision of a separate clamping basket has the advantage of easy replacement in case of damage and the option of combining various embodiments of clamping baskets and housings.

According to another feature of the present invention, the rotary sleeve, which interacts with the axially movable element, may have an internal thread for threaded engagement of the element. The element, e.g. the clamping basket or the pinch ring, may hereby have a complementary external thread to effect the axial movement of the element.

Besides the mechanical securement of a cable upon the housing of the plug assembly, the strain relief oftentimes has the task to seal the entry of the cable into the plug assembly against ingress of dust and/or moisture. For this purpose, it may be suitable to provide an elastic sealing collar inside the clamping basket. As the clamping fingers of the clamping basket are compressed, the sealing collar is then urged from all sides firmly against the cable sheathing, thereby preventing any ingress between cable and sealing collar. When the plug assembly is assembled, the sealing collar may be snugly fitted onto the housing and/or a ring-shaped carrier wall of the clamping basket. In this way, the cable is inserted in the plug assembly and cable basket in a tight manner.

A sealed attachment of the sealing collar onto the housing or carrier wall of the clamping basket may be realized through mechanical compression. Currently preferred is however a connection of the sealing collar to the housing or carrier wall by material union. For example, the sealing collar may be molded directly onto the respective part during manufacture.

According to another feature of the present invention, the rotary sleeve may be snugly sealed against the housing. As a result, the internal mechanism of the strain relief is protected against ingress of dirt and/or moisture. Such a sealing is easy to realize as a relative rotation only (without axial movement) is possible between rotary sleeve and housing.

According to another feature of the present invention, the rotary sleeve may include an insertion funnel for a cable to facilitate insertion of the cable into the clamping basket and feedthrough to the plug assembly.

According to another aspect of the present invention, a clamping basket for realizing a strain relief of a plug assembly includes a ring shaped carrier wall formed with axial clamping fingers which have free ends and include an outer surface having at least one part constructed in the form of a truncated cone which is defined by first and second radii, with the first radius disposed in closer proximity to the free ends of the clamping fingers and sized greater than the second radius. As a result, the outer sides of the clamping fingers extend, as viewed from the carrier wall, slantingly in relation to the axial direction radially outwards.

The cross section of the carrier wall may hereby be cylindrical or polygonal, for example.

A ring-shaped element (e.g. a shoulder of the housing or a pinch ring, as described above) to act on the described outer surfaces of the clamping basket may force the clamping fingers to move radially inwards, when moving axially away from the carrier wall. The clamping fingers are hereby advantageously responsive to tensile stress and thus not compressed in the direction of the carrier wall as encountered in conventional clamping baskets heretofore.

According to another feature of the present invention, a further part of the outer surface of the clamping fingers may be constructed in the form of a second truncated cone which is defined by first and second radii, with the first radius disposed in closer proximity to the free ends of the clamping fingers and sized smaller than the second radius. As a result, a second conical effective surface is formed, via which a compression of the clamping fingers can be realized through compressive force in a conventional manner, as an alternative.

According to another feature of the present invention, the clamping fingers may have a substantially triangular cross section in a radial direction. This results in the desired frustoconical configuration, on the one hand, and affords the clamping fingers with high stability, on the other hand. In particular, when very thin cable diameters are being clamped, such stability is beneficial as a bending or twisting of weaker clamping fingers is avoided.

According to another feature of the present invention, the carrier wall may have an internal thread and/or an external thread. As a result, the clamping basket can be tightly screwed onto the housing of the plug assembly for example. As an alternative, the thread of the carrier wall may also interact with the internal thread of a rotary sleeve in order to axially displace the clamping basket.

BRIEF DESCRIPTION OF THE DRAWING

Other features and advantages of the present invention will be more readily apparent upon reading the following description of currently preferred exemplified embodiments of the invention with reference to the accompanying drawing, in which.

DETAILED DESCRIPTION OF PREFERRED EMBODIMENTS

The depicted embodiments are to be understood as illustrative of the invention and not as limiting in any way. It should also be understood that the figures are not necessarily to scale and that the embodiments are sometimes illustrated by graphic symbols, phantom lines, diagrammatic representations and fragmentary views. In certain instances, details which are not necessary for an understanding of the present invention or which render other details difficult to perceive may have been omitted.

Figure 1:
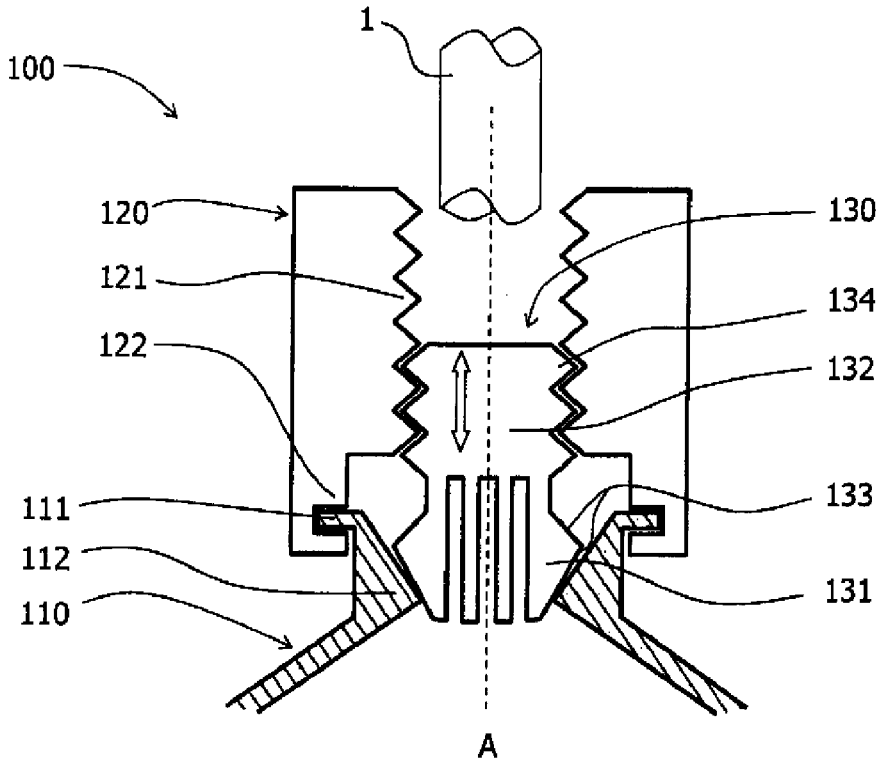
FIG. 1 is a schematic illustration of a plug assembly in accordance with a first principle of the present invention with axially movable clamping basket.

Turning now to the drawing, and in particular to FIG. 1, there is shown a schematic illustration of a plug assembly in accordance with a first principle of the present invention, generally designated by reference numeral 100. The plug assembly 100 includes essentially three components:

- a housing 110 which accommodates further components (not shown here) of the plug assembly, such as plug or socket inserts, for example.
- A rotary sleeve 120 which is supported on the housing 110 for rotation but substantially fixed in axial position. Such a support may, for example, be realized by providing the housing 110 with a radially outwardly projecting flange 111 and by providing the rotary sleeve 120 with a groove 122 in embracing relationship to the flange 111. The rotary sleeve 120 has an outer surface which can be grabbed by hand and/or a tool to effect a rotation of the rotary sleeve 120.

a clamping basket 130 having radially resilient clamping fingers 131 or segments which extend in axial direction A. As shown in FIG. 1, the clamping fingers 131 are articulated to a ring-shaped carrier wall 132. When forced radially inwards, the clamping fingers 131 are able to bear upon a sheathing of a cable 1 (shown only in part) which extends along the axis A from outside into the housing 110.

The rotary sleeve 120 has an inner structure which interacts with the clamping basket 130 in such a manner that the clamping basket 130 moves axially, when the rotary sleeve 120 is rotated. In the non-limiting example of FIG. 1, the inner structure of the rotary sleeve 120 is formed as an internal thread 121 which cooperates with an outer thread 134 on the carrier wall 132 of the clamping basket 130.

Further provided is a mechanism by which the axial movement of the clamping basket 130 is converted into a radial movement of the clamping fingers 131. This mechanism is realized by providing the clamping fingers 131 with outer surfaces 133 which extend slantingly in relation to the axis A and interact with a ring-shaped shoulder 112 on the housing 110 (or, as an alternative, on the rotary sleeve 120) to effect the radially inwards displacement of the clamping fingers 131. As shown in FIG. 1, a downwardly directed movement of the clamping basket 130 causes the clamping fingers 131 to compress. Although not shown in the drawing, in the event the clamping fingers 131 are arranged below the shoulder 112, a radially inward movement of the clamping fingers is implemented by a movement of the clamping basket in opposite direction, i.e. upwards in axial direction.

As a result of this type of configuration of the plug assembly 100, the rotary sleeve 120, which is actuated from outside, assumes a fixed axial position in relation to the housing 110. As a result, there are no gaps of variable width, when the rotary sleeve 120 is rotated so that the interior of the mechanism is protected in an optimum manner from external influences.

Figure 2:
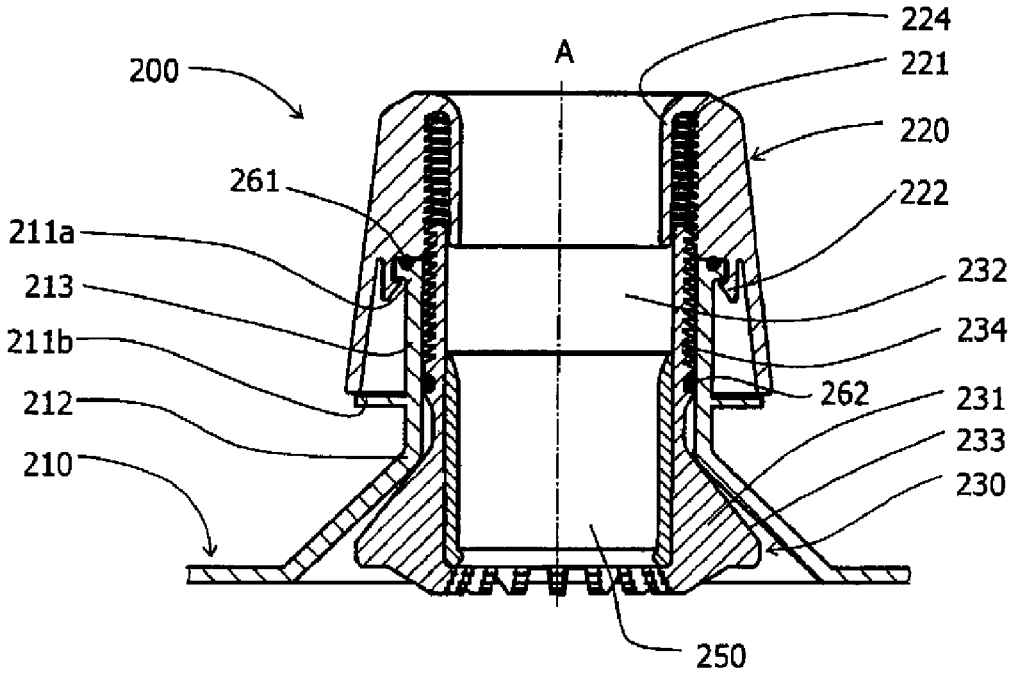
FIG. 2 is a sectional view of a plug assembly according to the present invention, constructed according to the first principle.

Referring now to FIG. 2, there is shown a sectional view of a plug assembly according to the present invention, constructed according to the first principle and indicated by reference numeral 200. In the following description, parts corresponding with those in FIG. 1 will be identified, where appropriate for the understanding of the invention, by corresponding reference numerals each increased by "100". The plug assembly is again shown only by way of its rearward end of the housing 210, typically designated as "cap". The housing 210 ends in a cylinder wall 213 which is continued at a shoulder 212 by a conically widening region.

Supported on the cylinder wall 213 for rotation about the axis A is a rotary sleeve 220 which is secured in axial direction through abutment against two flanges 211*a* and 211*b* of the housing 210. The rotary sleeve 220 is hereby secured against detachment in an upward axial direction by a locking lug 222 which is able to deflect elastically radially outwards, when the rotary sleeve 220 is installed. An annular seal 261 is disposed between the rotary sleeve 220 and the housing 210 to prevent ingress of dirt and moisture into the interior of the mechanism.

The rotary sleeve 220 is formed on the inside with an internal thread 221 and has an upper end which is turned inwards to form a funnel-shaped configuration 224 in spaced-apart surrounding relationship to the internal thread 221. The funnel 224 facilitates hereby the insertion of the cable 1 (not shown).

Received in the housing 210 is a clamping basket 230 which is movable in axial direction but constraint against executing a rotation and includes a ring-shaped carrier wall 232 (arranged atop in FIG. 2) from which clamping fingers 231 extend axially downwards. The carrier wall 232 has an external thread 234 which engages the internal thread 221 of the rotary sleeve 220. The clamping basket 230 can thus be moved upwards or downwards in axial direction in dependence on a rotation of the rotary sleeve 220. An annular seal 262 is received between the carrier wall 232 and the cylinder wall 213 of the housing 210 to provide a seal between the carrier wall 232 and the cylinder wall 213 in all axial positions.

The clamping fingers 231 have a substantially triangular radial cross section with sliding surfaces 233 extending slantingly in relation to the axis A. The sliding surfaces 233 interact with the shoulder 212 of the housing 210 in such a way that the clamping fingers 231 are urged radially inwards in the direction of a cable being inserted, when the clamping basket 230 is moved axially upwards. Teeth on the inside of the free end of the clamping fingers 231 may be provided to dig into the sheathing of the cable 1 to ensure a secure mechanical fixation.

The plug assembly 200 further includes an elastic, sleeve-like sealing collar 250 which is arranged inside the clamping basket 230 and extends essentially from the free end of the clamping fingers 231 towards the carrier wall 232. When the clamping fingers 231 are compressed, the lower end of the sealing collar 250, as viewed in FIG. 2, is urged firmly against the sheathing of the cable. The upper end of the sealing collar 250 is connected, suitably in a sealing manner, with the interior of the carrier wall 232, for example through material union by way of a two-component injection-molding process.

Figure 3:
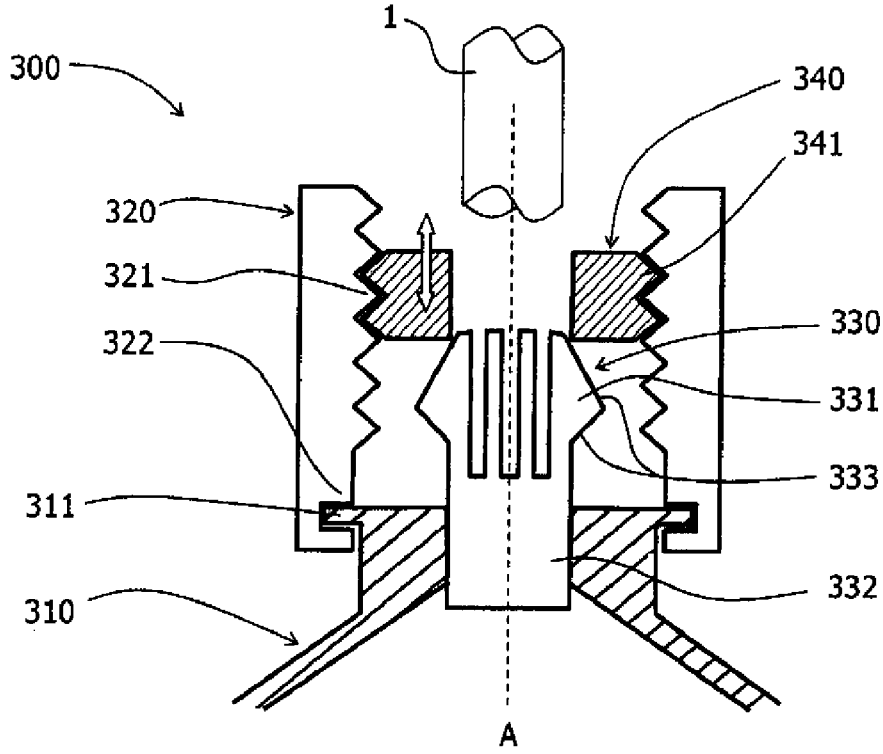
FIG. 3 is a schematic illustration of a plug assembly in accordance with a second principle of the present invention with axially movable pinch ring.

Referring now to FIG. 3, there is shown a schematic illustration of a plug assembly in accordance with a second principle of the present invention, generally designated by reference numeral 300. In the following description, parts corresponding with those in FIG. 1 will be identified, where appropriate for the understanding of the invention, by corresponding reference numerals each increased by "200". The plug assembly 300 includes essentially four components.

A housing 310 which resembles basically the housing 110 in FIG. 1.

A rotary sleeve 320 which also resembles basically the rotary sleeve 120 in FIG. 1 and is able to rotate but is supported axially fixed on the housing 310.

A clamping basket 330 which may also resemble the clamping basket 130 in FIG. 1, however the clamping basket 330 is now axially fixed in relation to the housing 310 (more generally: movable axially to a lesser extent or differently than the pinch ring 340 referred to hereinafter). The clamping basket 330 may be formed in one piece with the housing 310.

A pinch ring 340 which is movable axially and non-rotatably supported inside the rotary sleeve 320.

The rotary sleeve 320 has an inner structure, such as, e.g., an internal thread 321, to cooperate with a complementing structure, e.g. an external thread 341, on the pinch ring 340 in order to move the pinch ring 340 in axial direction when the rotary sleeve 320 is rotated. As a result of the axial movement of the pinch ring 340, a radially inwardly directed force can be applied upon the slanted outer surfaces 333 of the clamping fingers 331 of the clamping basket 330 to urge the clamping fingers 331 against the cable 1. Depending on the course of the outer surfaces 333 and position of the pinch ring 340, the radial compression of the clamping fingers 331 may be accompanied with a compression of the clamping fingers 331 in the direction of the carrier wall 332 or with a pull away from the carrier wall 332. FIG. 3 shows only the situation of compression.

The second constructive principle according to FIG. 3 has the advantage that the clamping basket 330 can remain fixed in relation to the housing 310. This prevents relative movements between the clamping basket 330 and cable 1 and simplifies the implementation of a reliable sealing against the housing 310.

Figure 4:
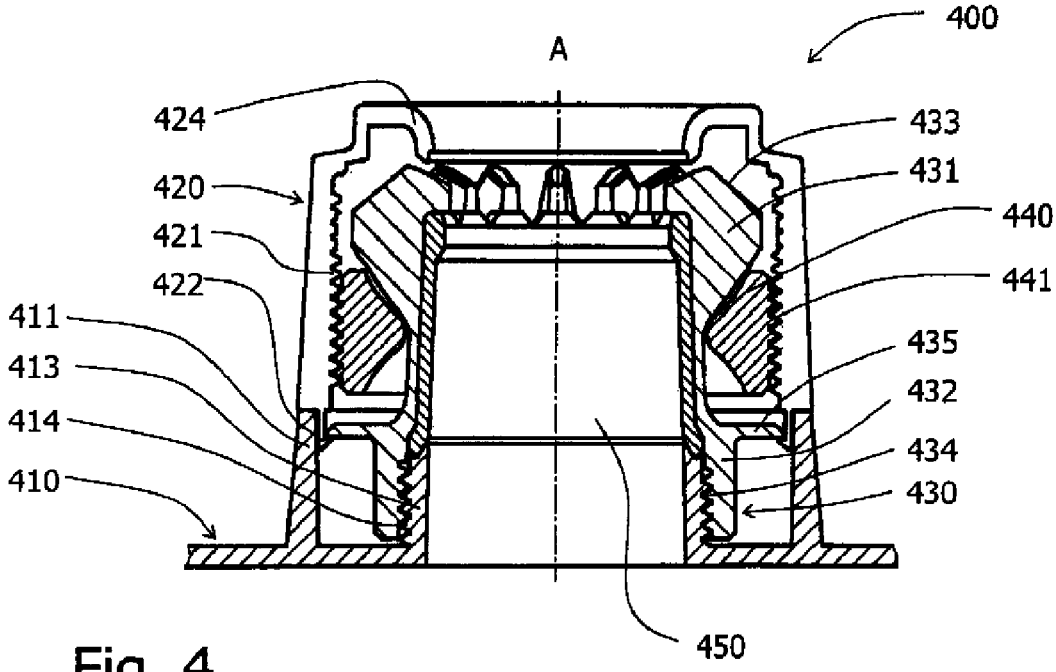
FIG. 4 is a sectional view of a plug assembly according to the present invention, constructed according to the second principle.

FIG. 4 shows a concrete implementation of the strain relief of a plug assembly according to the second constructive principle of FIG. 3, generally designated by reference numeral 400. In the following description, parts corresponding with those in FIG. 3 will be identified, where appropriate for the understanding of the invention, by corresponding reference numerals each increased by "100".

The housing 410 ends in a cylindrical piece 413 which is provided with an external thread 414 for threaded engagement of a complementary internal thread 434 of the ring-shaped carrier wall 432 of the clamping basket 430. The clamping basket 430 is firmly connected in this way to the housing 410. The clamping fingers 431 of the clamping basket 430 extend from the carrier wall 432 away from the plug assembly, i.e. upwards as viewed in FIG. 4. The clamping fingers 431 (or claws) are again constructed above their point of articulation in a triangular manner, with two outer surfaces 433 extending slantingly in relation to the axial direction A.

A rotary sleeve 420 is rotatably supported on the end of the housing 410. The rotary sleeve 420 rests hereby on a collar 411 of the housing 410. A locking lug 422 prevents the rotary sleeve 420 from being detached in axial upward direction and engages behind a radially projecting flange 435 of the clamping basket 430. An internal thread 421 is formed on an inner wall of the rotary sleeve 420, and the rotary sleeve 420 has an upper end which is inwardly turned to form an insertion funnel 424 for the cable 1.

The plug assembly 400 further includes a separate pinch ring 440 which has an external thread for engagement in the internal thread 421 of the rotary sleeve 420. The axial position of the non-rotatably supported pinch ring 440 is thus modified by a rotation of the rotary sleeve 420. The pinch ring 440 bears with an inner shoulder upon a slanted outer surface 433 of the clamping fingers 431 to convert the axial displacement of the pinch ring 440 into a positional change of the clamping fingers 431 in radial direction. In the illustrated exemplary embodiment of FIG. 4, this means concretely a compression of the clamping fingers 431, when the pinch ring 440 is moved radially upwards.

FIG. 4 further shows the presence of a sealing collar 450 which has a lower end which is firmly pressed by the clamping basket 430 upon the cylinder wall 413 of the housing 410. The upper end of the sealing collar 450 is pressed firmly against the cable sheath, after the cable has been inserted and the strain relief is tightened so that the transition from cable to housing 410 is sealed against the outside.

While the invention has been illustrated and described in connection with currently preferred embodiments shown and described in detail, it is not intended to be limited to the details shown since various modifications and structural changes may be made without departing in any way from the spirit and scope of the present invention. The embodiments were chosen and described in order to explain the principles of the invention and practical application to thereby enable a person skilled in the art to best utilize the invention and various embodiments with various modifications as are suited to the particular use contemplated.

What is claimed as new and desired to be protected by Letters Patent is set forth in the appended claims and includes equivalents of the elements recited therein.

What is claimed is:

1. A plug assembly with strain relief, comprising:

a housing;

a clamping basket having radially movable clamping fingers, with the clamping basket defining an axis and constructed to allow insertion of a cable into the housing in a direction of the axis; and a rotary sleeve supported on the housing for rotation but fixed in an axial position with respect to the housing, without formation of a gap of variable width to thereby protect and interior space from external influence, with the rotary sleeve being configured to move an element in the direction of the axis within the interior space, when rotated, to thereby modify a radial position of the clamping fingers.

2. The plug assembly of claim 1, wherein the element is the clamping basket.

3. The plug assembly of claim 1, wherein the clamping basket is snugly sealed on the housing and supported on the housing so as to be constraint against executing a rotation.

4. The plug assembly of claim 2, wherein the clamping fingers have an outer surface configured to interact with at least one member selected from the group consisting of the housing and the rotary sleeve, when the clamping basket is moved in the axial direction.

5. The plug assembly of claim 1, wherein the element is a pinch ring.

6. The plug assembly of claim 1, wherein the clamping basket is formed in one piece with the housing.

7. The plug assembly of claim 1, wherein the clamping basket is constructed for attachment to the housing.

8. The plug assembly of claim 1, wherein the rotary sleeve has an internal thread for threaded engagement of the element.

9. The plug assembly of claim 1, further comprising an elastic sealing collar received inside the clamping basket.

10. The plug assembly of claim 9, wherein the sealing collar is snugly fitted onto the housing in an assembled state of the plug assembly.

11. The plug assembly of claim 10, wherein the sealing collar is connected to the housing by material union.

12. The plug assembly of claim 9, wherein the clamping basket has a ring-shaped carrier wall, said sealing collar being snugly fitted onto the carrier wall in an assembled state of the plug assembly.

13. The plug assembly of claim 12, wherein the sealing collar is connected to the carrier wall by material union.

14. The plug assembly of claim 1, wherein the rotary sleeve is snugly sealed against the housing.

15. The plug assembly of claim 1, wherein the rotary sleeve includes an insertion funnel to facilitate insertion of the cable into the clamping basket.

* * * * *

UNITED STATES PATENT AND TRADEMARK OFFICE

CERTIFICATE OF CORRECTION

PATENT NO. : 7,980,885 B2
APPLICATION NO. : 12/393570
DATED : July 19, 2011
INVENTOR(S) : Stefan Gattwinkel et al.

It is certified that error appears in the above-identified patent and that said Letters Patent is hereby corrected as shown below:

Column 8, line 17, claim 1: before “interior”: change “and” to --an--.

Signed and Sealed this
Fifteenth Day of November, 2011

David J. Kappos

David J. Kappos
*Director of the United States Patent and Trademark Office*